US006065994A

United States Patent [19]

Hashim et al.

[11] Patent Number: 6,065,994

[45] Date of Patent: May 23, 2000

[54] LOW-CROSSTALK ELECTRICAL CONNECTOR GROUPING LIKE CONDUCTORS TOGETHER

[75] Inventors: Amid I. Hashim, Randolph; Golam M. Choudhury, Warren; Theodore A. Conorich, Lake Hiawatha; Frank P. Baker, III, Chatham, all of N.J.

[73] Assignee: Lucent Technologies Inc., Murray Hill, N.J.

[21] Appl. No.: 08/858,234

[22] Filed: May 19, 1997

Related U.S. Application Data

[63] Continuation-in-part of application No. 08/673,711, Jun. 21, 1996, Pat. No. 5,716,237.

[51] Int. Cl.[7] ..... H01R 4/24

[52] U.S. Cl. ..... 439/404; 439/941

[58] Field of Search ..... 439/941, 404, 439/676

[56] References Cited

U.S. PATENT DOCUMENTS

| | | | |
|---|---|---|---|
| 5,299,956 | 4/1994 | Brownell et al. | 439/941 |
| 5,310,363 | 5/1994 | Brownell | 439/941 |
| 5,362,257 | 11/1994 | Neal et al. | 439/941 |
| 5,679,027 | 10/1997 | Smith | 439/941 |
| 5,679,097 | 10/1997 | Smith | 439/941 |
| 5,716,237 | 2/1998 | Conorich et al. | 439/941 |

*Primary Examiner*—Steven L. Stephan
*Assistant Examiner*—Jean F. Duverne

[57] ABSTRACT

An electrical connector (e.g., a plug or receptacle for a plug) has multiple conductors that carry two or more transmission paths, where each transmission path uses (at least) two conductors to carry a balanced signal. A portion of the like conductors of one type are grouped together and separated from a portion of like conductors of another type. For example, in one embodiment, the electrical connector is a plug having contacts used to terminate a multi-wire cable carrying up to four voice or data signal transmission paths and having four pairs of TIP-RING contacts, where a portion of the four TIP contacts are grouped together and a portion of the four RING contacts are grouped together and separated from the group of TIP contacts. In this way, electromagnetic (e.g., capacitive and/or inductive) coupling between like conductors (e.g., from TIP contact to TIP contact) will be generated that opposes electromagnetic coupling between unlike conductors (e.g., from TIP contact to RING contact) which may otherwise result in unacceptable levels of crosstalk between transmission paths in the electrical connector.

7 Claims, 3 Drawing Sheets

LOW-CROSSTALK ELECTRICAL CONNECTOR GROUPING LIKE CONDUCTORS TOGETHER

CROSS-REFERENCE TO RELATED APPLICATIONS

This is a continuation-in-part of application Ser. No. 08/673,711, filed Jun. 21, 1996 and issued as U.S. Pat. No. 5,716,237 on Feb. 10, 1998.

BACKGROUND OF THE INVENTION

1. Field of the Invention

The present invention relates to electrical connectors, and, in particular, to plugs and receptacles designed to reduce crosstalk between adjacent conductors of different transmission paths.

2. Description of the Related Art

Near-end crosstalk refers to unwanted signals induced in one transmission path due to signals that are transmitted over one or more other transmission paths appearing at the end nearest to where the transmitted signals are injected. Near-end crosstalk often occurs when the wires and/or other conductors that form the various transmission paths are in close proximity to one another. A classic example of near-end crosstalk is the signals induced during some voice transmissions that result in parties to one telephone call hearing the conversation of parties to another call. An example that would benefit from this invention is when high-speed data transmission is impaired due to coupling of unwanted signals from one path to another.

One type of plug used to terminate multi-wire cords is the 110-type patch cord plug, manufactured by Lucent Technologies, Inc., of Murray Hill, N.J. A 110 patch plug can be mated to the insulation displacement contacts (IDCs) of a 110-type connecting block, which is also manufactured by Lucent Technologies. One end of the 110 patch cord plug terminates permanently a multi-wire cordage; the other end mates removably to a 110-type connecting block. The 110 patch cord plug is often used in voice and data transmission applications. In such transmissions, each pair of conductors within a multi-wire cable, called the TIP conductor and the RING conductor, that carries balanced signals constitutes a single signal transmission path. A typical 8-wire cable can therefore support four different voice or data signal transmission paths.

A 110-type patch cord plug can have one or more pairs of conductors (typically 1, 2, 3, or 4 pairs). One end (i.e., the mating end) of each plug conductor has a blade contact to engage the split-beam contacts of a 110-type connecting block. The other end (i.e., the cable end) of each plug conductor has a split-beam contact to enable termination of the patch cord cordage conductors. The blade contacts are sequenced in a linear alternating fashion between TIP and RING conductors in order to be aligned with the split-beam contacts of the mating connecting block.

FIG. 1 shows perspective, top, and side views of the conductors of a prior art 110-type patch plug. FIG. 2 shows a schematic diagram of the cable and mating ends of a prior art 110-type patch plug. As shown in FIGS. 1–2, a 110 patch plug has up to four pairs of conductors, each pair ($T_i$, $R_j$) corresponding to a single balanced transmission path. Due to the proximity of the transmission paths within plugs (such as the 110 patch cord plug), signals in one transmission path can induce crosstalk in one or more adjacent transmission paths within the same plug. For example, signals in the transmission path transmitted through TIP contact $T_2$ and RING contact $R_2$ can induce crosstalk in the transmission path consisting of TIP contact $T_1$and RING contact $R_1$, as well as in the transmission path consisting of TIP contact $T_3$ and RING contact $R_3$.

What is needed are plugs, such as patch cord plugs, and their accompanying receptacles, such as connecting blocks, that are designed to have low crosstalk between the transmission paths of multi-wire circuits. Previous attempts at reducing crosstalk have involved increasing the distance between transmission paths (i.e., from one pair of conductors to another) and/or decreasing the distance within each transmission path (i.e., between the two conductors of a single pair). Another approach is to introduce opposing crosstalk that is out of phase with the existing crosstalk. This is often done by designing a cross-over (i.e., a physical crossing of one conductor over another) in one or more pairs of conductors, while possibly leaving other pairs of conductors without a cross-over. The patch plug of FIG. 1 shows cross-over within each pair of conductors.

SUMMARY OF THE INVENTION

One aspect of the present invention is a novel design for electrical connectors, such as patch plugs and connecting blocks, that have low crosstalk between transmission paths transmitted through such a connector.

Embodiments of the present invention are directed to one or more low-crosstalk electrical connectors comprising four or more conductors adapted to carry two or more transmission paths. Each transmission path uses two types of conductors to carry a balanced signal, wherein parts of like conductors are grouped together, and unlike groups are separated from one another.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

The present invention is directed to electrical connectors, such as patch cord plugs and connecting blocks, that are designed to have low crosstalk between transmission paths. The cable ends of such electrical connectors are configured such that those contacts corresponding to like signals of one type (e.g., TIP signals) are grouped together and separated from those conductors corresponding to like signals of another type (e.g., RING signals).

Figure 3:
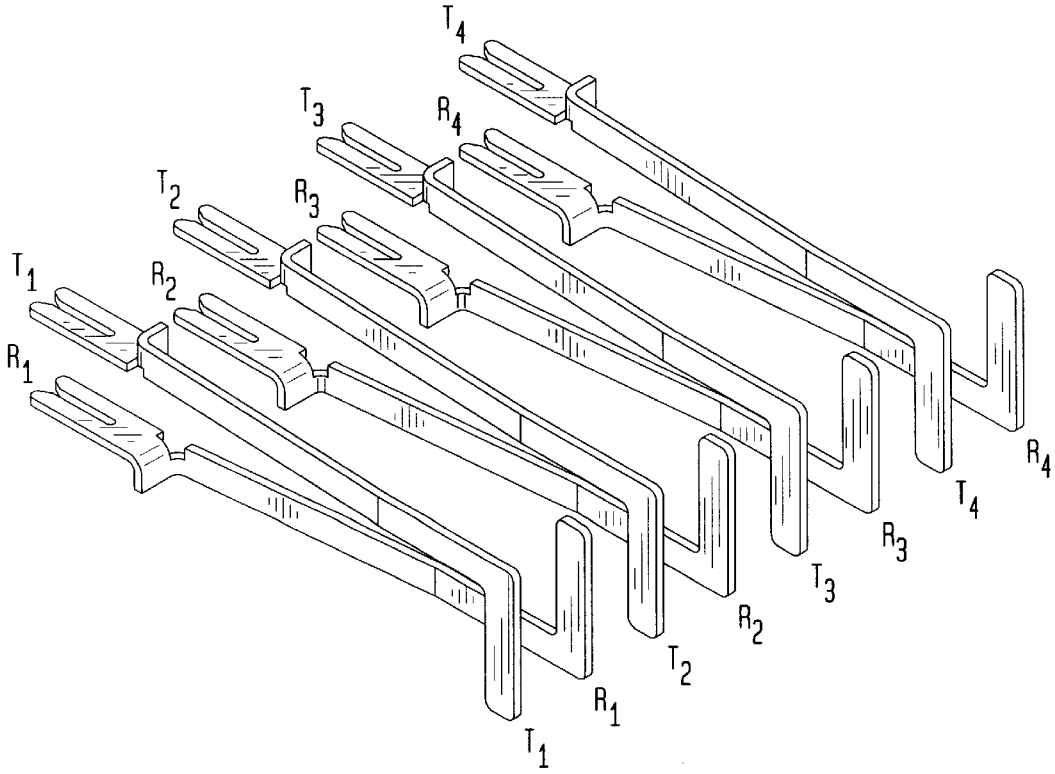
FIG. 3 shows a perspective view of the conductors of a patch plug, in accordance with one embodiment of the present invention.
Figure 4:
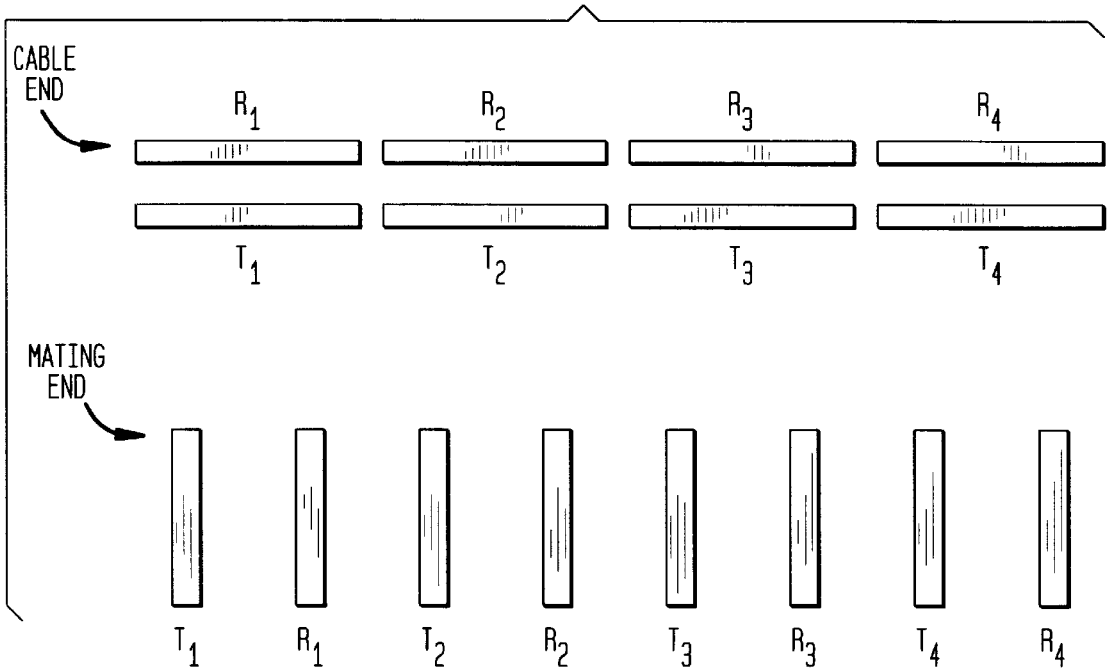
FIG. 4 shows a schematic diagram of the cable and mating ends of the patch plug of FIG. 3.

FIG. 3 shows a perspective view of the conductors of a patch plug, in accordance with one embodiment of the present invention. FIG. 4 shows a schematic diagram of the cable and mating ends of the patch plug of FIG. 3. The patch plug is designed for voice and data signal transmission applications and has up to four pairs of TIP and RING cable-end contacts, where the contacts are configured such that:

The four TIP contacts ($T_1$–$T_4$) are grouped together (i.e., one next to the other) in the X direction;

The four RING contacts ($R_1$–$R_4$) are grouped together in the X direction;

The group of RING contacts is separated from the group of TIP contacts in the Y direction; and For each pair of TIP and RING contacts ($T_i$, $R_j$), the TIP contact $T_i$ is positioned opposite the RING contact $R_i$ in the Y direction.

The mating end of the patch plug of FIGS. 3 and 4 preferably conforms to the requirements for compatibility with 110-type connectors, such that the patch plug can be mated to a 110-type connecting block.

The inventors have found that the configuration of the cable-end plug contacts shown in FIGS. 3–4 reduces the amount of crosstalk in a mated patch-plug/connecting-block configuration between different TIP-RING transmission paths. In one implementation of a patch plug constructed according to the present invention, the measured level of near-end crosstalk loss was better than 55 dB at 100 MHz.

Figure 1A:
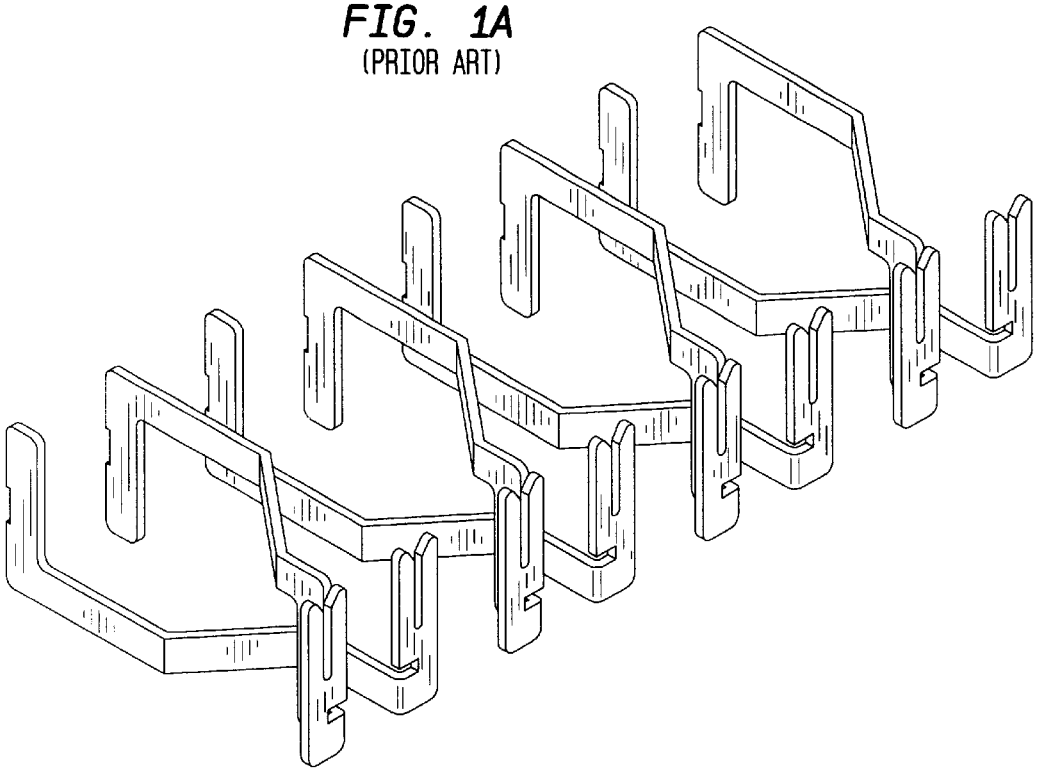
FIG. 1A (PRIOR ART)
FIG. 1 shows perspective, top, and side views of the conductors of a prior-art 110-type patch plug.
Figure 1B:
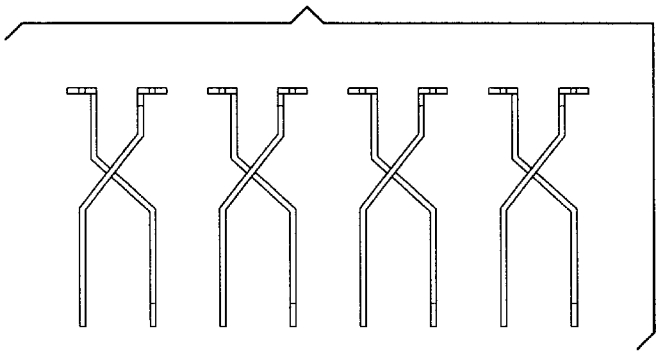
FIG. 1B (PRIOR ART)
Figure 1C:
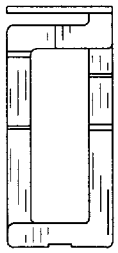
FIG. 1C (PRIOR ART)
Figure 2:
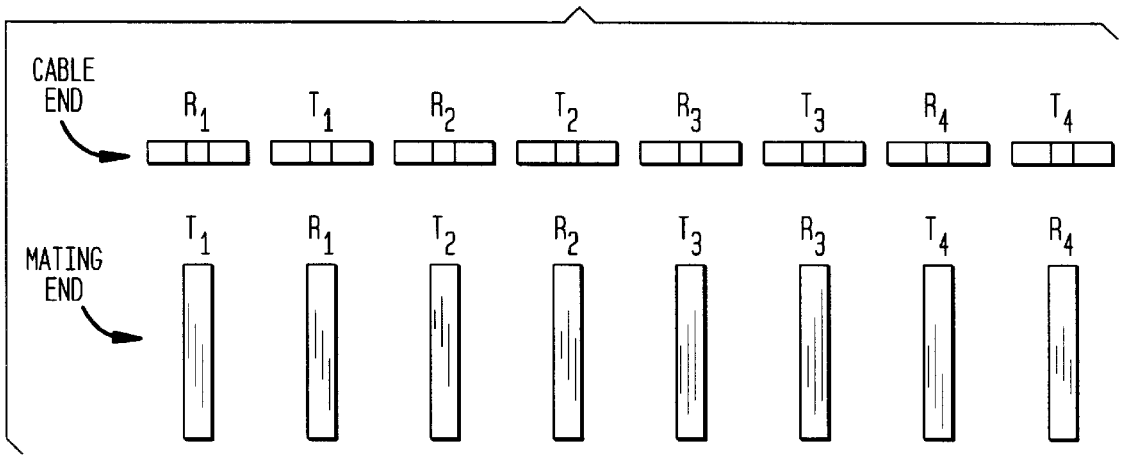
FIG. 2 (PRIOR ART)
FIG. 2 shows a schematic diagram of the cable and mating ends of a prior-art 110-type patch plug.

Near-end crosstalk in the patch plug of FIGS. 1–2 results mostly from electromagnetic (e.g., capacitive and/or inductive) coupling between unlike conductors of adjacent TIP-RING pairs. Thus, in FIGS. 1–2, for example, crosstalk between the first TIP-RING path and the second TIP-RING path may result primarily from electromagnetic coupling between RING contact $R_1$ of the first TIP-RING path and the adjacent TIP contact $T_2$ of the second TIP-RING path.

It is believed that the configuration of the patch plug of FIGS. 3–4 reduces crosstalk that would otherwise result from electromagnetic coupling between unlike conductors of adjacent TIP-RING pairs at the mating end by increasing the capacitive and/or inductive coupling between like conductors of adjacent pairs at the cable end (e.g., between TIP contact $T_1$ and TIP contact $T_2$ and between RING contact $R_1$ and RING contact $R_2$). The increased electromagnetic coupling between like conductors at one end in FIGS. 3–4 opposes the electromagnetic coupling between unlike conductors of adjacent pairs at the other end (e.g., between RING contact $R_1$ and TIP contact $T_2$ of FIG. 4), thereby resulting in a relatively low level of crosstalk between the two TIP-RING paths of two adjacent transmission paths.

The crosstalk compensation in patch plugs of the present invention can be made sufficient to oppose and substantially reduce by cancellation the crosstalk generated in a mated combination of the patch cord plug and connecting block. The same type of cancellation between adjacent transmission TIP-RING pairs can be achieved by abutting 1, 2, 3, or 4 pair plugs of the same basic crosstalk-canceling construction.

It will be understood that the shapes, heights, widths, and separation distances along both X and Y directions can be selected to achieve the desired level of crosstalk reduction. For example, the cable-end contacts need not be rectangular in shape. In general, the configuration of FIGS. 3–4 may be adjusted as necessary to ensure that the capacitive and/or inductive coupling between like conductors in one area opposes the capacitive and/or inductive coupling between unlike conductors in another area to a sufficient degree to reduce crosstalk to an acceptable level.

Figure 5:
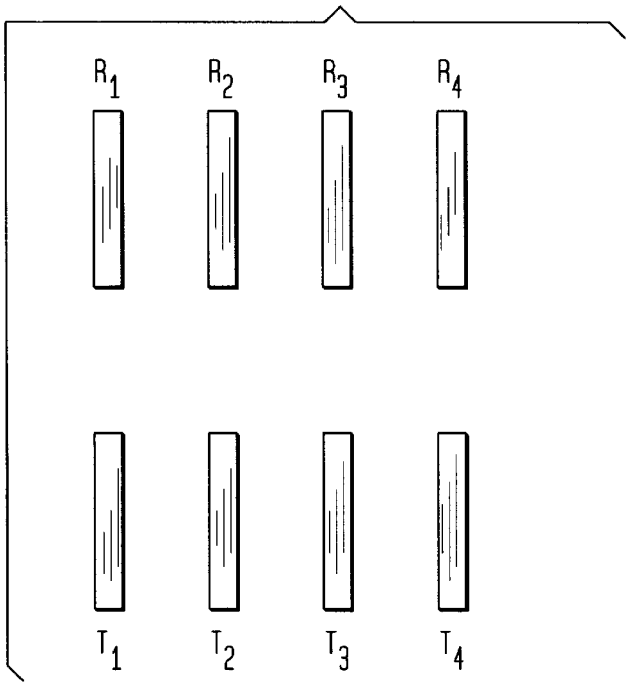
FIG. 5 shows a schematic diagram of the cable end of a patch plug, according to an alternative embodiment of the present invention.

FIG. 5 shows a schematic diagram of the cable-end contacts of a patch plug, according to an alternative embodiment of the present invention. As in the configuration of FIG. 4, the alternative configuration of FIG. 5 would tend to generate electromagnetic coupling between like conductors that opposes the electromagnetic coupling between unlike conductors and therefore reduce crosstalk between transmission paths carried by the plug. It will be understood that additional alternative configurations fall within the scope of the present invention.

It will be further understood that embodiments of the present invention may have more or less than four pairs of TIP-RING contacts, and that the resulting plugs may be used for applications other than voice or data signal transmission.

In the embodiment of FIGS. 3–4, the grouping of like conductors is applied to the cable end of the connector, which preferably can be mated, at its mating end, to a 110-type connecting block. It will be understood that, in alternative embodiments, the grouping of like conductors may be applied to the mating end of the connector rather than the cable end. Obviously, the mating ends of such connectors would not conform to the requirements of 110-type connectors.

Although much of the description has been directed to plugs, the present invention also applies to receptacles adapted to mate with (i.e., receive) such plugs.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. An electrical connector comprising two or more pairs of conductors, each pair consisting of a TIP conductor and a RING conductor, wherein:

at a mating end of the connector, the TIP and RING conductors for all of the pairs of conductors are aligned in an alternating sequence with the TIP and RING conductors of each pair immediately adjacent to one another;

at a cable end of the connector, the TIP conductors for all of the pairs of conductors are aligned in a first row of conductors;

at the cable end of the connector, the RING conductors for all of the pairs of conductors are aligned in a second row of conductors substantially parallel to and offset from the first row of conductors; and from the mating end to the cable end of the connector, each pair of conductors rotates approximately 90° within its own volume and without its conductors crossing over each other or any conductor of another pair in the connector, wherein:

the connector provides (a) crosstalk compensation between each pair of conductors within the connector and every other pair of conductors within the connector as well as (b) crosstalk compensation between each pair of conductors within the connector and every pair of conductors within another such connector configured side by side with the connector such that the rows of conductors at the mating end and the cable end between the two connectors are substantially colinear.

2. The invention of claim 1, wherein the connector is a 110-type connector.

3. The invention of claim 1, wherein each conductor has a mating contact at the mating end of the connector and a cable contact adapted to receive a cable conductor at the cable end of the connector.

4. The invention of claim 3, wherein the connector is a 110-type connector.

5. The invention of claim 3, wherein:

the cable contact for each TIP conductor is oriented substantially parallel to the row of TIP conductors at the cable end of the connector; and the cable contact for each RING conductor is oriented substantially parallel to the row of RING conductors at the cable end of the connector.

6. The invention of claim 3, wherein:

the cable contact for each TIP conductor is oriented substantially perpendicular to the row of TIP conductors at the cable end of the connector; and the cable contact for each RING conductor is oriented substantially perpendicular to the row of RING conductors at the cable end of the connector.

7. The invention of claim 3, wherein each cable contact is an insulation displacement contact.

* * * * *